US007976433B2

(12) United States Patent
Kenyon

(10) Patent No.: US 7,976,433 B2
(45) Date of Patent: Jul. 12, 2011

(54) BIOMECHANICAL DIAGNOSTIC MACHINE FOR BICYCLE FITTING, REHABILITATION AND TRAINING

(76) Inventor: Todd N. Kenyon, Barrington, RI (US)

( * ) Notice: Subject to any disclaimer, the term of this patent is extended or adjusted under 35 U.S.C. 154(b) by 0 days.

(21) Appl. No.: 12/891,678

(22) Filed: Sep. 27, 2010

(65) Prior Publication Data

US 2011/0077125 A1 Mar. 31, 2011

Related U.S. Application Data

(60) Provisional application No. 61/246,025, filed on Sep. 25, 2009.

(51) Int. Cl.
*A63B 71/00* (2006.01)

(52) U.S. Cl. ..... 482/4; 482/51; 482/57; 482/1; 434/61; 434/247

(58) Field of Classification Search ..... 482/1–9, 482/51, 57–65, 900–902; 434/61, 247
See application file for complete search history.

(56) References Cited

U.S. PATENT DOCUMENTS

| | | | | |
|---|---|---|---|---|
| 4,911,427 | A | 3/1990 | Matsumoto et al. | |
| 4,938,475 | A | 7/1990 | Sargeant et al. | |
| 5,042,795 | A | 8/1991 | Bursik | |
| 6,648,802 | B2 | 11/2003 | Ware | |
| 7,090,619 | B2 | 8/2006 | Miyamaru et al. | |
| 7,691,033 | B2 * | 4/2010 | Rolli | 482/51 |
| 7,762,931 | B2 * | 7/2010 | Fisher et al. | 482/57 |
| 7,905,817 | B2 * | 3/2011 | Giannascoli et al. | 482/57 |
| 2007/0003910 | A1 | 1/2007 | Kirila | |
| 2007/0142177 | A1 | 6/2007 | Simms et al. | |

OTHER PUBLICATIONS http://www.slowtwitch.com/Bike_Fit/Bike_Fit_Equipment_and_Tools/index.html.
http://www.smartcycles.com/fitting_explained.htm.
http://web.archive.org/web/20070205220209/www.cyclesimulator.com/simulator.htm.
http://www.bobzillabikes.com/Fitting.html.
http://www.retul.com/how-retul-works.asp.
http://bikedynamics.co.uk/index.html.
http://www.rideboutique.com//fitting.html—site no longer exists, references the "Waterford Fitmaster," which is found on http://fitmaster.net/site/.
http://www.castlehillcycles.com/bike-fit-austin.php.

* cited by examiner

*Primary Examiner* — Glenn Richman
(74) *Attorney, Agent, or Firm* — Robert L. Shaver; Dykas & Shaver LLP

(57) ABSTRACT

Presented is a bike fitting and diagnostic machine with adjustable rider contact points of the saddle, the pedals, and the handlebars. Adjustments can be made while the rider pedals, and while the rider's output is measured in watts, calories, heart rate, or other units. Optimal bike fit parameters are determined to help a rider select a well fitting bike or have one made to his specifications.

19 Claims, 1 Drawing Sheet

BIOMECHANICAL DIAGNOSTIC MACHINE FOR BICYCLE FITTING, REHABILITATION AND TRAINING

PRIORITY/CROSS-REFERENCE TO RELATED APPLICATIONS

This application claims the benefit of U.S. Provisional Application No. 61/246,025, filed Sep. 25, 2009, the disclosure of which is incorporated by reference.

TECHNICAL FIELD

The presently disclosed and claimed inventive concept generally relates to an apparatus for bicycles, and, and more particularly to an apparatus for measuring a rider to determine the proper dimensions for a bicycle to fit a particular rider.

BACKGROUND

If a bike rider can get the right fit on his bike, he can have the optimal power output from his effort. Sizing the frame and components of a bike to each rider means getting the seat height the optimal distance from the bottom bracket and pedals, having the seat at the right angle relative to the bottom bracket, and having the handlebars at the right height and extension ("drop" and "reach").

There are bike fitting devices where the rider sits on a device with pedals, bike seat, and handlebars, and each piece is manually moved, locked in place, and tested for comfort and power output.

This device is like those, but the rider can sit on the device, pedal, have his power output measured while he pedals, and each piece of the device can be moved electronically via remote control while he is riding. The power output can be monitored as each dimension changes, and adjusted to the optimal configuration for power output, aerodynamics, and comfort. Once the preferred configuration of rider contact points is established, a frame can be built to specification, or selected from off the shelf, that matches the rider's perfect configuration. This is especially useful to elite riders. The fit process can also point out what changes a rider can make to his existing bike to optimize his performance.

SUMMARY OF THE DISCLOSURE

The invention is an electronically-adjustable bicycle position/fit simulator. It allows 4 or more fit variables to be adjusted independently of each other, while the rider is riding under power. These include saddle height (distance from saddle to bottom bracket), seat angle (seat tube angle), reach, and drop. They can also include pedal crank arm length and seat tilt, and even specialized parameters such as aerobar pad placement and aerobar length, width, tilt, and spacing. This kind of fitting is especially useful for aero-position fitting. It incorporates a Computrainer, or other resistance unit, allowing power and "Spinscan" readouts on a PC so that the effect of position changes on these important performance parameters can instantly be seen. The rider's heart rate can also be monitored via the Computrainer interface or through other widely available monitoring devices, so that the rider's effort level relative to power output can be observed. This device will revolutionize bike fitting, because each of these measurement parameters based on the rider's optimal or preferred position can be changed while the rider is working under load, allowing the rider and fitter to quickly feel, see, and measure the effects in real time. A motion-analysis fit system can be used to measure body angles for bike fit optimization. Current static fit bikes require the rider to stop, maybe get off the unit, or at least stand or sit up while the fitter changes a dimension manually.

A major shortcoming of existing designs is that none allows the seat angle to be changed without either changing the seat height or saddle tilt, and/or reach or drop to the handlebars. The device of the invention accomplishes this by keeping the rider and saddle stationary, and pivoting the drive train beneath the rider and around a pivot point which matches the rider's saddle contact point. Hence, once a suitable distance to the pedals is determined, the seat angle can be adjusted via the pivot mechanism without changing the optimal distance to the pedals. These variables are independently adjustable so that the effects of each parameter, individually and collectively, can be related to rider performance, comfort, and aerodynamics. Existing designs are unable to maintain independence of the key fit parameters, these being: distance to the pedals, seat angle, seat tilt, and horizontal and vertical distance from saddle to handlebars. This design is most useful for teams and coaches to optimize position vs. performance; it will be useful for researchers examining the effects of biomechanics and position changes on performance; and it should also be very useful in the wind tunnel as rider position can be changed without stopping the tunnel, changing equipment and introducing artifacts. This will save time and money since tunnel usage is billed hourly, as well as produce accurate results.

The device is especially suited to aero-position fitting for triathlon or time trial riders. Bike fitting for the aero position requires a careful consideration of body angles to optimize power and aerodynamics. A key parameter is hip angle, which is affected by both effective seat tube angle and front end drop. Current bike fitting devices are not optimized for time trial fitting due to generally linear adjustments, whereas movement of the rider about the bottom bracket at a constant radius is the most relevant parameter for performance optimization. On existing designs, changing the seat angle will also change other fit variables. Typically, both saddle tilt and drop will change as the effective seat tube angle is changed, and reach to the handlebars and distance to the pedals may be changed as well. This is due to the mechanical constraints of these designs which all move the rider in various ways around the cycle contact points. The key design feature of this invention is that it moves the contact points about the rider while maintaining the rider stationary in space.

In addition, most or all existing fit bikes require the rider to stop pedaling and/or get off the bike to adjust various fit parameters. A system that allows adjustment of fit parameters WHILE the rider is pedaling, and power output is monitored, provides for absolute fit optimization.

The device will also be useful in a rehabilitation setting, as the therapist can adjust range of motion and muscle activation patterns gradually while the patient rides, via electronic adjustment of distance to the pedals and seat angle, and or torso angle via drop adjustment. This should be especially valuable in knee injury rehabilitation. For such an application the device may be modified through the addition of platforms to allow easy mount and dismount by the patient. Also, the front end may be modified to allow for less aggressive (higher) handlebar settings.

The device can also be used as a fully adjustable bike in a setting such as a spin class, with each user of the bike able to adjust the bike to his specific frame measurements. The device could have a programmed or remotely controlled load in such a situation, so the riders output would be changed with the class, or in response to his/her heart rate. Besides in the spin class situation, this load control would be useful in a rehabilitation setting.

The basic concept is to use a fixed frame and saddle position, with a telescoping "seat tube" attached to a pivot point located directly beneath the rider's contact point on the saddle. This innovative feature will allow saddle height to be determined, and then to remain essentially constant while changing effective seat tube angle (max range approx. 67-85 deg), or will allow constant seat tube angle while adjusting saddle height (distance from saddle to bottom bracket, approx range 60-90 cm). These adjustments will be accomplished via electronic linear actuators and/or stepper motors. The actuators/motors can be operated through simple push-button or other switches or adjustment knobs, or could be computer controlled, in either case, via wires or wirelessly. The cranks will drive a standard bike wheel, drum, air fan, magnetic resistor, or other load, with a power measuring instrument such as a Computrainer Resistance Unit for power monitoring and spin scanning, or some other power measuring unit. A chain or belt may be used, or the load can be applied to the axle. If a chain is used, it may require a tensioner to accommodate the range of movement of the bottom bracket. The seat tube unit may require lateral supports to prevent unwanted lateral movement during pedaling.

The bottom bracket refers to a conventional bike component which typically includes a short section of tubing surrounding an axle, with crank arms which attach to the ends of the axle, and pedals which attach to the crank arms. Some bicycle bottom brackets include a one piece axle and crank arm piece, with pedals attached. Typically, tubes of a bicycle attach to the shell of the bottom bracket, with the tubes of a typical bike being designated the seat tube, which extends from the saddle to the bottom bracket, and top tube, which extends from the seat tube forward to the head tube, the head tube, to which the handlebars are attached, the down tube, which extends from the head tube to the bottom bracket, seat stays, which extend from the seat tube to the rear wheel attachment, and chain stays, which extend from the bottom bracket to the rear wheel attachment.

The front end, or handlebar assembly, is adjustable in X and Y directions via actuators and/or stepper motors. The down motion determines the "drop" and the forward motion determines the "reach" of the handlebar position. The height of the front end is adjusted via a telescoping platform, and reach is be adjusted by moving the height assembly fore and aft on a telescoping or track system. The front end will include a section of standard steerer tube so that conventional front end assemblies (handlebars and aero bars) can be attached, and evaluated by the rider. Ideally, this "steerer stub" will be manually adjustable with regards to head tube angle (71-75 deg to simulate typical bicycle head angles), but may also be positionable or stationary at 90 degrees for easier x-y measurements.

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the inventive concept(s) of the application, which is measured by the claims, nor is it intended to be limiting as to the scope of the inventive concept(s) in any way.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DEFINITIONS

Figure 1:
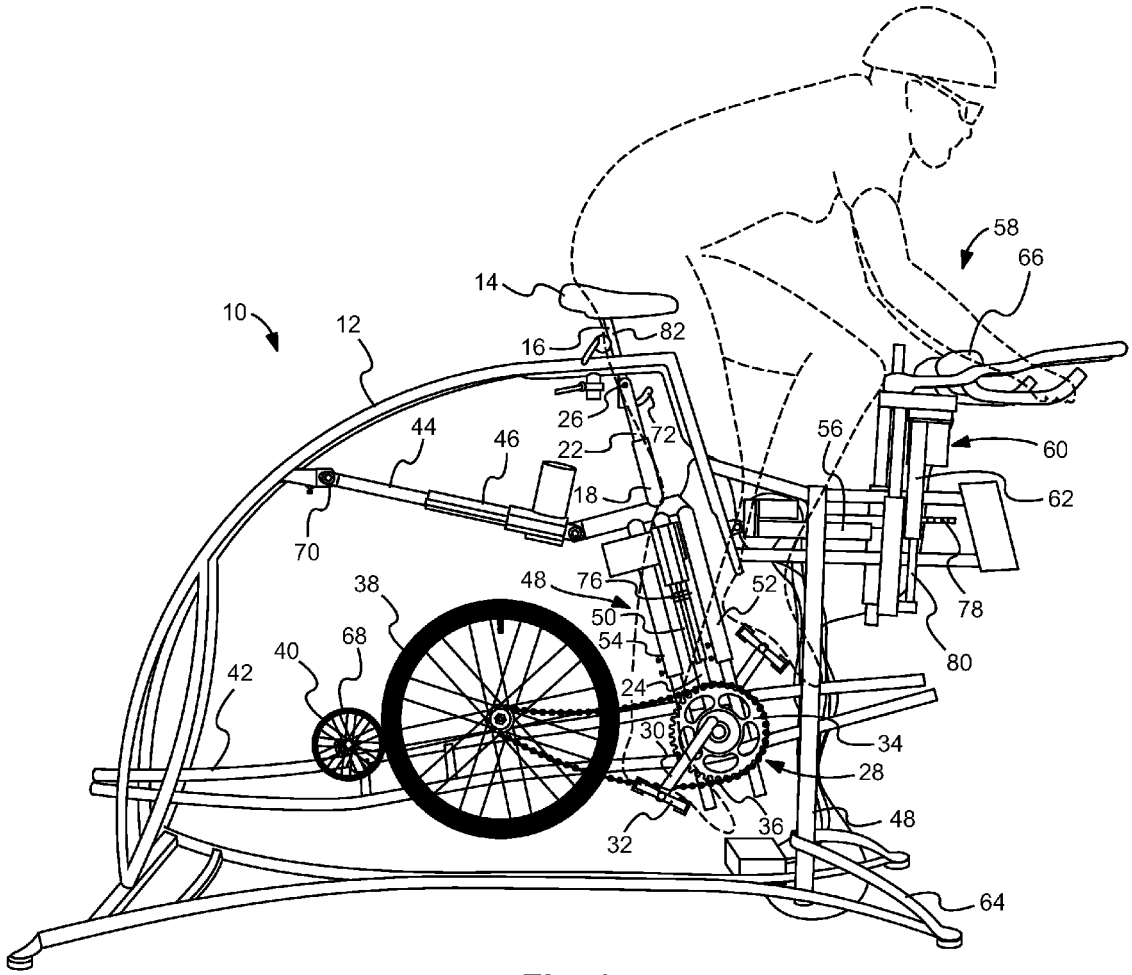
FIG. 1 is a perspective view of a diagnostic machine of the invention.

In the following description and in the figures, like elements are identified with like reference numerals.

The use of "e.g.," "etc," and "or" indicates non-exclusive alternatives without limitation unless otherwise noted.

The use of "including" means "including, but not limited to," unless otherwise noted.

DETAILED DESCRIPTION OF THE EXEMPLARY EMBODIMENT

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

Shown in FIG. 1 is a preferred embodiment of a diagnostic machine. The device of this embodiment is designated as 10, and includes a frame 12 on which a rider 20 sits when using the machine. The rider 20 sits as he normally would on a bicycle, utilizing the saddle 14 which is attached to the frame 12 via a saddle mount 16. Adjacent to the saddle mount 16 is a seat tube 18 which has a first end 22 and a second end 24. At the first end of the seat tube 22, the seat tube 22 is attached to the frame 12 at a pivot 26. At the second end of the seat tube 24 is a bottom bracket 28. The bottom bracket 28 is similar to bicycle bottom brackets in that it would typically contain an axle (not visible in FIG. 1), two crank arms 30 attached to the axle, and two pedals 32 attached to the crank arms 30. The bottom bracket is built like a bicycle bottom bracket with the axle enclosed within a tube, with bearings to support the axle so that it may freely rotate. Although this conventional bicycle style bottom bracket is shown, obviously pedal rotating assemblies of other designs are also possible, and within the scope of the invention. Attached to the axle in this embodiment is a chain ring 34 which would spin freely as the crank is turned by the crank arms and the pedals by the rider rotating his legs. Although a bicycle type saddle or seat is preferred, other types of seats may be used and still fall within the term, "saddle" as used in the claims. A saddle is equivalent to a seat.

The frame 12 may be built from standard rectangular, round, or oval steel or aluminum tubing, or any other suitable structural material, and the telescoping sections could be any suitable shape which allows the prescribed functions. The frame 12 of the device could obviously be made of a number of different materials but tubular steel has been found to be a good material for the frame, with square or round tubing being suitable. Round tubing of approximately 1.5 inches in diameter has proven to be useful for parts of the frame, and round tubing of 1" diameter has been found to be suitable for some of the smaller parts of the frame. The material used in the frame, the type of tubing, and the diameter of the tubing is not a critical consideration.

The frame 12 includes stabilizing legs 64, configured to provide sufficient support and stability to the device while a rider is seated and pedaling.

In this embodiment of the device, a chain 36 engages the chain ring 34 and turns a wheel 38 which spins as the rider turns the cranks. Connected to the wheel 38 is a load 68 and a power measuring instrument 40. The load provides resistance to the turning of the cranks, and can be based on a friction brake on the wheel, magnetic resistance, an air fan for providing resistance, or by an electrical resistance device. Alternatively, the resistance unit and power measuring device may be one and the same as in the Computrainer.

The power measuring instrument 40 measures the amount of force or energy that the rider puts out at various positions of the device. In this way the device can be adjusted for optimal power output in combination with optimal comfort and aerodynamics, so that the optimal measurements of a bicycle frame can be determined for a particular rider. From the measured bicycle frame characteristics the rider can select one of a number of off-the-shelf bicycle frames which fall within the parameters of his measurements. Another option is for the rider to have a custom bike frame built which meets his measured frame requirements perfectly.

Attached to the second end 24 of the seat tube 18 is a swing arm 42. In this embodiment of the device, the swing arm 42 is attached rigidly to the seat tube 18, and forms an upside down asymmetrical T with swing arm 42. The seat tube 18 and the attached swing arm 42 are configured to pivot from the pivot 26. This embodiment includes a seat tube positioner 44 which telescopes in and out in order to move the seat tube 18 back and forth within the plane of the frame. The seat tube extender 44 thus changes the angle of the seat tube. This is measured as the angle between a line extending from the saddle 14 to the bottom bracket 28 and horizontal. In this embodiment the swing arm 42 is made of stainless steel tubing, and forms a sub frame on which the rear wheel 38 and load 68 and power measuring instrument 40 can be attached. A scale 72 is used in this embodiment to obtain a seat tube angle, with other forms of measuring this angle being equally workable, such as an inclinometer. The two ends of the swing arm 42 pass through passages in the frame 12 for alignment and stabilization purposes.

The seat tube positioner 44 is a linear actuator, which in this embodiment is electrically powered using an electric motor which extends the telescoping tube of the seat tube positioner 44 by use of a screw. The telescoping tube 46 of the seat tube positioner 44 attaches to the frame 12, at an anchor point 70 for the seat tube positioner in pivoting the seat tube back and forth within the plane of the frame 12 and within the plane of the diagnostic machine.

The actuators for the seat tube positioner 44 are available from Firgelli Automations, or similar suppliers. One that has proven to be advantageous is a Firgelli Model FA-400 actuator, which runs on 12v dc, and can expand from approximately 13 inches to 19 inches. The telescoping sections in this embodiment are an aluminum tube inside an aluminum housing, and in this embodiment are extended by use of a screw. Other means of extending the telescoping portion could be by use of hydraulics, pneumatics, gears, or other convention transport system.

The seat tube also includes a seat tube length assembly 48. The seat tube length assembly 48 includes a seat tube extender 50, and in this embodiment also includes a fore and aft guide rod, 52 and 54. The seat tube extender 50 is a linear actuator, which in this embodiment is electrically powered using a motor which extends the telescoping tube of the seat tube positioner 44 by use of a screw. As the tube extender 50 moves in and out, the distance between the pivot 26 and the bottom bracket 28 changes. With the use of the seat tube extender 50 and the seat tube positioner 44, the rider or a technician can find the perfect angle for the seat tube as well as the perfect distance between the saddle and the bottom bracket. These are two of the measurements which are obtained by the diagnostic machine 10. A seat tube length scale 76 is provided to give a measurement of the seat tube length, from the saddle or the pivot to the bottom bracket.

The device also includes a handlebar and handlebar extender assembly 56 which moves the handlebar assembly 58 away from the saddle, or toward the saddle. By these motions, the diagnostic machine finds the optimal "reach" for a particular rider. Similar linear actuator components and telescoping tubes are used in the handlebar extender assembly 56. The preferred handlebar extender assembly 56 used a linear actuator, which in this embodiment is electrically powered using a motor which extends the telescoping tube of the seat tube positioner 44 by use of a screw. A reach scale 78 is provided to give a measurement of the handlebar horizontal distance from the saddle to the handlebars. Although a bicycle type handlebar is shown, other types of handgrip type devices are also usable including straight bars, therapeutic bars, cowhorn bars, or bars of any configuration.

The device also includes a handlebar lifter assembly 60 which includes a handlebar lifter 62 which is a linear actuator. By moving the handlebar lifting assembly 60 up and down, the ideal height of the handlebars is determined. This is called the "drop" and is another important measurement for achieving the correct sizing of a bicycle frame. The handle lifter assembly 60 uses similar linear actuator components as those used in the handlebar extender assembly 56. A drop scale 80 is provided to give a measurement of the handlebar position relative to a horizontal line from the saddle or seat post upper end. Obviously, the scales of the device could be wireless and digital, or analog and visually observable.

The diagnostic machine also includes a control console 66. Although the control console is shown being mounted on the handlebar 58, it could be also mounted on other positions of the frame, or could be operated at a position remote from the bicycle frame. The advantage of having the control console 66 on the handlebar assembly 58 is that the rider can control the linear actuators associated with the machine and thus can move the adjustable portions of the device until the right combination of frame settings is achieved, by moving the rider contact points for optimal comfort and power output, and optionally aerodynamic efficiency. Wind tunnel testing can be a part of the use of this device, with measurements yielding a frame for a ride in which aerodynamic efficiency is optimized, or at least factored into the other goals of comfort and power output.

Attached to the frame is a seat post or saddle mount 16, to which is mounted a saddle 14. The saddle 14 may be tilted or moved back and forth on the seat post, to find the optimal position for the rider. The tilting or motion of the saddle could also be controlled from the control panel using the same technology as in the other adjustment assemblies.

The length of the crank arms 32 may also be controlled from the control panel using the same technology as in the other adjustment assemblies. The rider contact portions of the handlebars could be also adjustable using the same technology as in the other adjustment assemblies. The angle of the hand grips, the width of the hand grips, the position of arm pads in relation to the hand grips could all be adjustable.

An important feature of these components of the device is that the rider remains stationary, while the contact points move to find the most efficient position.

Although the preferred embodiment shown is consistent with a diamond frame bike, such as a road bike or a mountain bike, the basic components could easily be modified to bike frame types such as a two or three wheeled recumbent bike. The same parameters would be determined, but in a recumbent bike the bottom bracket would be about as high as the rider's saddle or higher. A different frame structure of the device would be used, which allowed the bottom bracket to be as high as the rider's saddle. Another measure that would be measured is the seat angle of the back of the seat, because in recumbents, the seat is higher and supports part of the back. Lumbar support would also be adjustable, to find the best seat shape for a rider. Instead of seat tube length and angle, the distance from bottom bracket to saddle and the angle of bottom bracket to saddle would be measured. Optimal position of a headrest could also be measured. All of these measurements would be determined for a combination of comfort, power output, and aero efficiency. The measurements for recumbents could be for competitive riders, speed record bike builds, or for riders undergoing rehabilitation.

While certain exemplary embodiments are shown in the Figure and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

What is claimed is:

1. A biomechanical diagnostic machine for fitting a bicycle frame for a bicycle rider, comprising:

a frame for supporting a bicycle rider, said frame comprising three contact points for a bicycle rider, comprising a bicycle saddle, bicycle pedals, and bicycle handlebars;

a bicycle saddle attached to said frame, configured to support said rider in a riding position;

a seat tube with a first end and a second end, with said first end pivotally attached to said frame at a pivot attached to said frame adjacent to said bicycle saddle, and attached to a bottom bracket at said second end, said seat tube configured to telescope in or out to increase or decrease the distance between said pivot and said bottom bracket, with said seat tube configured to pivot in the plane of said frame to change the angle of the seat tube relative to horizontal, with said telescoping motion powered by at least one linear actuator and said pivoting motion powered by one or more linear actuators, with said linear actuators controlled from a control console;

a drive train rotatably mounted in said bottom bracket and comprising an axle with a left and right pedal attached, with said axle configured for rotation in said bottom bracket;

a load attached to said drive train, for providing resistance to said axle rotation; and a handlebar assembly attached to said frame, comprising a bicycle handlebar, and vertical and horizontal adjustment assembly each powered by one or more linear actuators, with said linear actuators controlled from said control console:

wherein said biomechanical diagnostic machine is configured for adjustment of handlebar drop and reach, angle of said seat tube, and distance between said saddle and said bottom bracket.

2. The biomechanical diagnostic machine of claim 1 which further comprises a power measuring instrument for measuring an output of power from said drive train.

3. The biomechanical diagnostic machine of claim 1 which is configured for remote adjustment of said points of contacts by said rider while pedaling under load.

4. The biomechanical diagnostic machine of claim 1 in which said control console is attached to said frame adjacent to said handlebar assembly.

5. The biomechanical diagnostic machine of claim 1 in which said load is a wheel, disc, air moving fan, fluid resistance unit or roller, driven from said drive train of said bottom bracket.

6. The biomechanical diagnostic machine of claim 1 in which said machine load wheel is driven by a circular power band from said bottom bracket.

7. The biomechanical diagnostic machine of claim 6 in which said drivetrain further comprises a chain ring for transmitting power from said axle, and at least one rear chain ring attached to said wheel, for transmitting power from said chain to said rear wheel.

8. The biomechanical diagnostic machine of claim 5 which further comprises a resistance generator selected from the group consisting of an air moving fan, magnetic resistor, friction resistor, fluid resistor or an electronic resistor.

9. The biomechanical diagnostic machine of claim 1 in which said load is adjustable by computer control.

10. The biomechanical diagnostic machine of claim 1 in which said control console is operable from a location remote from said machine.

11. The biomechanical diagnostic machine of claim 1 in which said drive train and said computer controlled resistance unit attach to said second end of said seat tube, and extends and pivots along with said bottom bracket as the seat tube is extended or pivoted in the plane of said frame for adjustment of fit.

12. The biomechanical diagnostic machine of claim 1 in which said crank arms are adjustable in length.

13. The biomechanical diagnostic machine of claim 1 in which said saddle is adjustable in fore and aft placement over said seat tube, and adjustable in angle from horizontal.

14. The biomechanical diagnostic machine of claim 1 which includes a numerical position indicators for bottom bracket angle to top of seat tube, extension of seat tube, and drop and reach of handlebars.

15. The biomechanical diagnostic machine of claim 1 in which said seat tube angle is adjustable from <70 degrees to >80 degrees (measured from horizontal).

16. The biomechanical diagnostic machine of claim 1 in which bicycle fit parameters, including distance from saddle to bottom bracket, seat tube angle, and drop and reach of handlebars are each adjustable automatically and independent of one another, while said rider is pedaling under load.

17. The biomechanical diagnostic machine of claim 1 which includes a support stand attached to said frame.

18. The biomechanical diagnostic machine of claim 1 in which said linear actuators include support assemblies comprised of at least one stabilizing bar, parallel with said linear actuators.

19. A biomechanical diagnostic machine for fitting a bicycle frame for a bicycle rider, comprising:

a frame for supporting a bicycle rider, said frame comprising three contact points for a bicycle rider, comprising a stationary bicycle saddle, bicycle pedals, and bicycle handlebars;

a bicycle saddle attached to said frame adjacent to a seat tube, configured to support said rider in a riding position;

a seat tube with a first end and a second end, with said first end pivotally attached to said frame at a pivot and attached to said frame adjacent to said bicycle saddle, and attached to a bottom bracket at said second end, said seat tube configured to telescope in or out to increase or decrease the distance between said pivot and said bottom bracket, with said seat tube configured to rotate in the plane of said frame to change the angle of the seat tube to horizontal, with said telescoping motion powered by at least one linear actuator and said pivoting motion powered by one or more linear actuators and configured for adjustment while said rider is pedaling, with said linear actuators controlled from a control console;

a drive train rotatably mounted in said bottom bracket and comprising an axle with a left and right pedal attached, with said axle configured for rotation in said bottom bracket;

a load attached to said drive train, for providing resistance to said axle rotation; and a power measuring instrument for measuring an output of power from said drive train;

a handlebar assembly configured for adjustment while said rider pedals, said handlebar assembly attached to said frame and comprising a bicycle handlebar, and vertical and horizontal adjustment assembly each powered by one or more linear actuators, with said linear actuators controlled from said control console;

wherein said biomechanical diagnostic machine is configured for adjustment of handlebar drop and reach, angle of said seat tube, and distance between said saddle and said bottom bracket.

* * * * *